US012092324B2

(12) United States Patent
Kim et al.

(10) Patent No.: US 12,092,324 B2
(45) Date of Patent: Sep. 17, 2024

(54) FLARE CONE FOR A MIXER ASSEMBLY OF A GAS TURBINE COMBUSTOR

(71) Applicant: General Electric Company, Schenectady, NY (US)

(72) Inventors: Kwanwoo Kim, Cincinnati, OH (US); Varun Lakshmanan, Bengaluru (IN); Sripathi Mohan, Bengaluru (IN); Vivekta Sharma, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 134 days.

(21) Appl. No.: 17/655,196

(22) Filed: Mar. 17, 2022

(65) Prior Publication Data

US 2023/0296245 A1 Sep. 21, 2023

(51) Int. Cl.

| | |
|---|---|
| ***F23D 14/62*** | (2006.01) |
| ***F23D 14/70*** | (2006.01) |
| ***F23D 14/78*** | (2006.01) |
| ***F23R 3/14*** | (2006.01) |

(52) U.S. Cl.

CPC ..... *F23D 14/62* (2013.01); *F23D 14/70* (2013.01); *F23D 14/78* (2013.01); *F23R 3/14* (2013.01); *F23D 2214/00* (2013.01)

(58) Field of Classification Search

CPC ..... F23D 14/78; F23D 14/70; F23D 14/62; F23R 3/14; F23R 3/286

USPC ..... 60/748, 749; 431/354

See application file for complete search history.

(56) References Cited

U.S. PATENT DOCUMENTS

| | | | | |
|---|---|---|---|---|
| 5,490,378 | A | 2/1996 | Berger et al. | |
| 5,623,827 | A * | 4/1997 | Monty | F23R 3/10 60/804 |
| 5,765,376 | A * | 6/1998 | Zarzalis | F23R 3/10 60/752 |
| 5,934,067 | A * | 8/1999 | Ansart | F23R 3/04 60/804 |
| 6,279,323 | B1 * | 8/2001 | Monty | F23R 3/14 60/752 |
| 7,246,494 | B2 | 7/2007 | Currin et al. | |
| 8,033,114 | B2 | 10/2011 | Hernandez et al. | |
| 8,171,735 | B2 | 5/2012 | Mancini et al. | |
| 8,312,723 | B2 | 11/2012 | Pieussergues et al. | |

(Continued)

FOREIGN PATENT DOCUMENTS

| | | |
|---|---|---|
| EP | 1600693 B1 | 8/2016 |
| FR | 3033030 B1 | 4/2018 |

*Primary Examiner* — Vivek K Shirsat

(74) *Attorney, Agent, or Firm* — Venable LLP; Edward A. Kmett; Michele V. Frank

(57) ABSTRACT

A flare cone for a mixer assembly includes an annular conical wall extending circumferentially about a mixer assembly centerline, the annular conical wall including a conical inner surface defining a conical opening of the annular conical wall, and an annular axial wall extending in a longitudinal direction with respect to the mixer assembly centerline, the annular axial wall disposed at a radially outward portion of the annular conical wall and connected to the annular conical wall. The annular conical wall and the annular axial wall define an annular step circumferentially about the mixer assembly centerline and extending upstream in the longitudinal direction between a downstream end of the annular conical wall and an aft surface of the annular axial wall.

19 Claims, 7 Drawing Sheets

(56) References Cited

U.S. PATENT DOCUMENTS

| | | | |
|---|---|---|---|
| 10,288,293 | B2 | 5/2019 | Barnhart et al. |
| 10,598,381 | B2 | 3/2020 | Drake et al. |

* cited by examiner

FLARE CONE FOR A MIXER ASSEMBLY OF A GAS TURBINE COMBUSTOR

TECHNICAL FIELD

The present disclosure relates to a flare cone for a mixer assembly of a combustor of a gas turbine engine.

BACKGROUND

Some conventional gas turbine engines are known to include rich-burn combustors that typically use a swirler integrated with a fuel nozzle to deliver a swirled fuel/air mixture to a combustor. A radial-radial swirler is one example of such a swirler and includes a primary radial swirler, a secondary radial swirler, and a flare cone connected to the secondary swirler. The primary swirler includes a primary swirler venturi in which a primary flow of swirled air from the primary swirler mixes with fuel injected into the primary swirler venturi by the fuel nozzle, thereby generating a swirled primary fuel-air mixture. The secondary swirler provides a secondary flow of swirled air downstream of the primary swirler, where the secondary flow of swirled air mixes with the swirled primary fuel-air mixture, thereby generating a swirled fuel-air mixture. The swirled fuel-air mixture then flows downstream to a flare cone connected to a downstream end of the secondary swirler. The flare cone has a conical inner surface that disperses the swirled secondary fuel-air mixture into the combustion chamber, where it is ignited and burned to generate combustion product gases.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
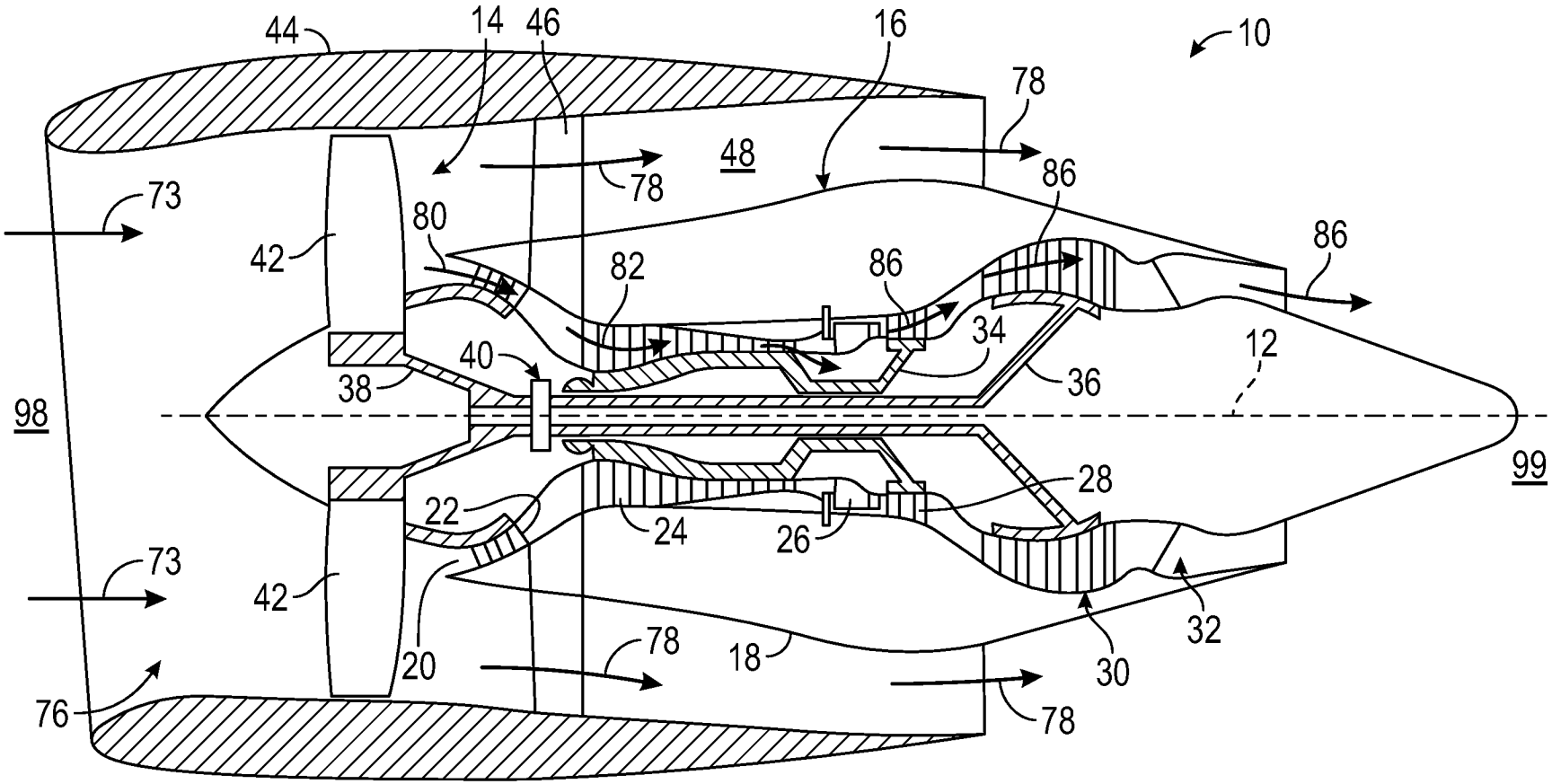
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, it is to be understood that the following detailed description are exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a rich-burn combustor that includes a radial-radial swirler, air is provided from a pressure plenum of a combustor to a primary swirler, where a swirl is induced in the air by swirl vanes in the primary swirler as it flows through the primary swirler. The primary swirler also includes a venturi, and a fuel nozzle injects fuel into the venturi, where it is mixed with the swirled air flow of the primary swirler to generate a swirled primary fuel-air mixture. A secondary swirler provides a secondary flow of swirled air downstream of the primary swirler, where the secondary flow of swirled air mixes with the swirled primary fuel-air mixture, thereby generating a swirled fuel-air mixture. The swirled fuel-air mixture then flows downstream of the secondary swirler to a flare cone connected to a downstream end of the secondary swirler.

The flare cone expands the swirled fuel-air mixture along a diverging conical-angled surface prior to entering the combustor, where it is ignited and burned to generate combustion product gases. Conventional flare cones utilize a fixed diverging conical-angled surface and include a sharp edge at an outlet end of the conical-angled surface. In addition, the conventional flare cone includes a backside cooling slot that has a fixed angle that generally matches with the angle of the conical-angled surface. Due to the fixed conical-angled surface and the sharp edge, a defined flow separation occurs from the sharp edge such that, the swirling flow expands at an angle equal to or less than the diverging conical-angled surface of the flare cone. The resulting flow is therefore susceptible to combustion instability, which is promoted by an unsteady interaction of the flame, a corner vortex formed in the flow at the sharp edge, and a cooling flow provided by the dome.

The present disclosure addresses the foregoing to reduce the unsteady interaction of the flame with the cooling flow of the dome by providing an aerodynamic turning of the flow over the flare cone and dome to minimize combustion dynamics. According to the present disclosure, in one aspect, an annular step with a defined width and height is provided on the flare cone outer end instead of the sharp edge. In another aspect, a contoured inner surface of the flare cone is provided so as to allow a steeper angled flow closer to the outlet end of the flare cone. Both the annular step and the contoured surface provide for a smoother transition of the flow of the fuel-air mixture exiting the flare cone at the outer edge, thereby, reducing the unsteady flame motion. In addition, the flare cone shape can influence the flame shape and make the flame more resistant to pressure fluctuations.

Referring now to the drawings, FIG. 1 is a schematic partial cross-sectional side view of an exemplary high by-pass turbofan jet engine 10, herein referred to as "engine 10," may incorporate various embodiments of the present disclosure. Although further described below with reference to a ducted turbofan engine, the present disclosure is also applicable to turbomachinery in general, including turbojet, turboprop, and turboshaft gas turbine engines, including marine and industrial turbine engines and auxiliary power units. In addition, the present disclosure is not limited to ducted fan type turbine engines such as that shown in FIG. 1, but can be implemented in unducted fan (UDF) type turbine engines. As shown in FIG. 1, engine 10 has a longitudinal or axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
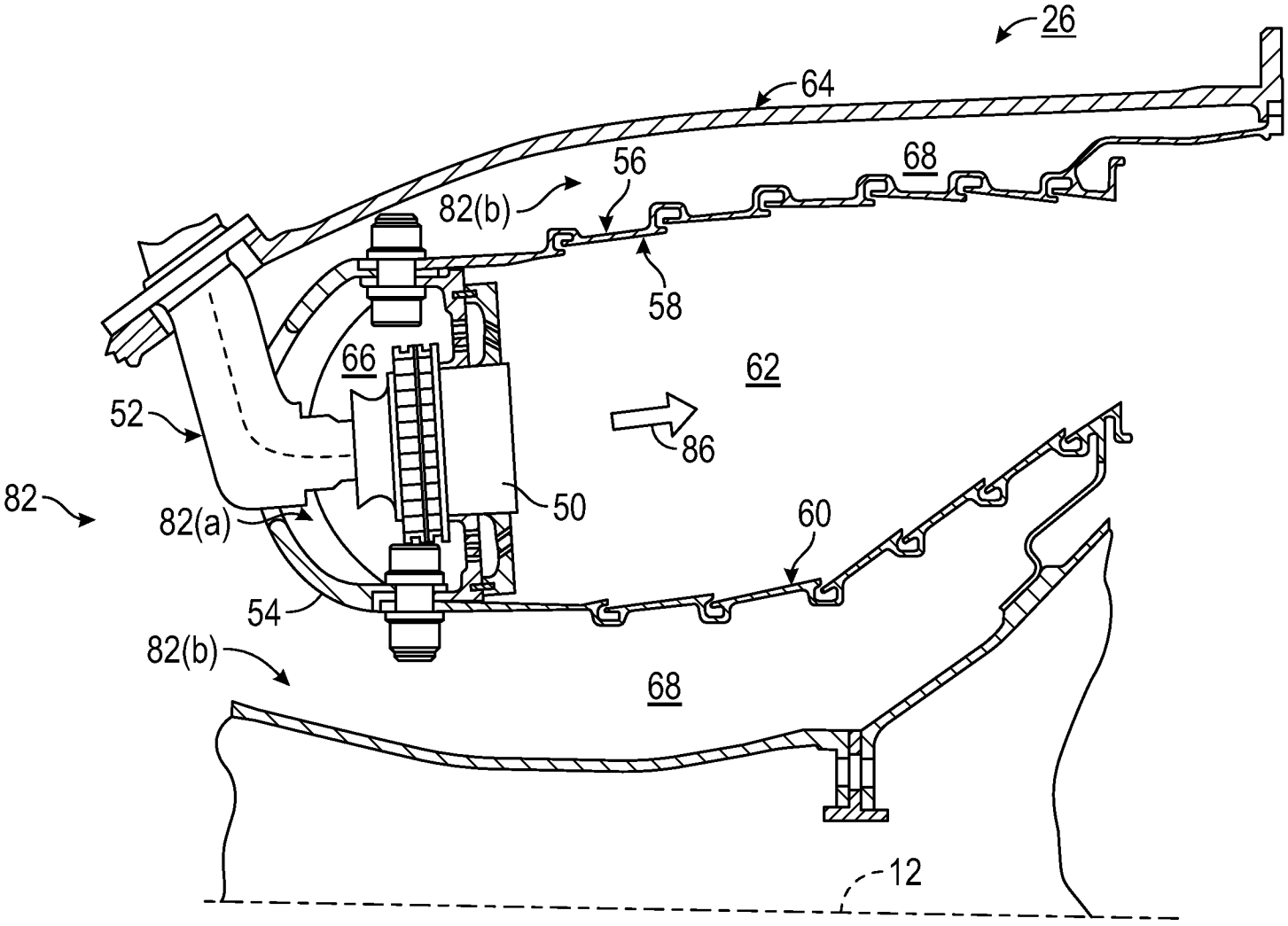
FIG. 2 is a partial cross-sectional side view of an exemplary combustion section, according to an aspect of the present disclosure.

FIG. 2 depicts an exemplary combustion section 26 according to the present disclosure. In FIG. 2, combustion section 26 includes a mixer assembly 50, a fuel nozzle assembly 52, a dome assembly 54, and an annular combustion liner 56 within outer casing 64. The annular combustion liner 56 includes an annular outer liner 58 and an annular inner liner 60 forming a combustion chamber 62 therebetween. A pressure plenum 66 is formed within the dome assembly 54. Referring back to FIG. 1, in operation, air 73 enters the nacelle 44, and a portion of the air 73 enters the compressor section as compressor inlet air flow 80, where it is compressed. Another portion of the air 73 enters the bypass airflow passage 48, thereby providing a bypass airflow 78. In FIG. 2, air 82 from the compressor section (22/24) enters the combustion section 26 via a diffuser (not shown). A portion of the air 82(*a*) enters the dome assembly 54 to the pressure plenum 66, while another portion of the air 82(*b*) passes to an outer flow passage 68 between the annular combustion liner 56 and the outer casing 64. As will be described below, air 82(*a*) in the pressure plenum 66 passes through the mixer assembly 50 to mix with fuel ejected by the fuel nozzle assembly 52 and is ignited to generate combustion product gases 86.

Figure 3:
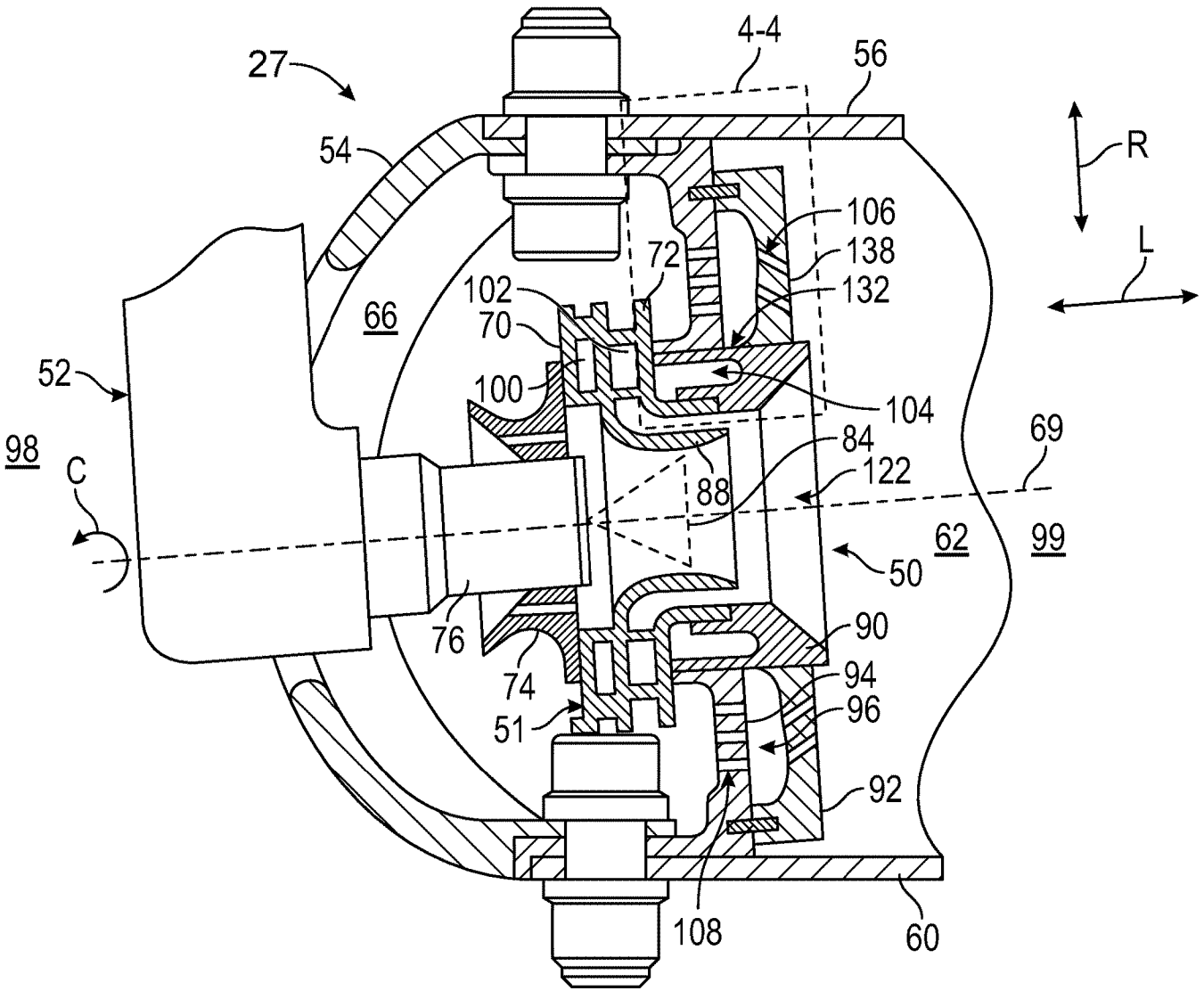
FIG. 3 is a partial cross-sectional side view of a forward portion of the of an exemplary combustion section of FIG. 2.

FIG. 3 depicts a partial cross-sectional view of a forward portion of a combustor 27 in the combustion section 26, including mixer assembly 50. In FIG. 3, the combustor 27 defines its own longitudinal direction L relative to the engine centerline axis 12 (see FIG. 1), and radial direction R relative to the engine centerline axis 12. The mixer assembly 50 is generally symmetrical about mixer assembly centerline 69, which extends in the longitudinal direction L and is generally perpendicular to the radial direction R. The mixer assembly 50 is suitably connected to dome assembly 54, including via support wall 94. The mixer assembly 50 includes a swirler assembly 51 and a fuel nozzle 76 disposed within the swirler assembly 51. The swirler assembly 51 includes a primary swirler 70 that has a primary swirler venturi 88, a secondary swirler 72, and a swirler ferrule plate 74. The primary swirler 70 includes a plurality of primary swirler swirl vanes 100 that are circumferentially disposed in a row such that each of the primary swirler swirl vanes 100 extends radially inward. The primary swirler 70 also includes primary swirler venturi 88 that extends in the longitudinal direction L concentrically about mixer assembly centerline 69. The primary swirler 70 is configured for swirling a corresponding portion of the pressurized air 82(*a*) from the pressure plenum 66 radially inward in a primary swirl direction within the primary swirler 70 (i.e., either clockwise about mixer assembly centerline 69, or counterclockwise about mixer assembly centerline 69).

The secondary swirler 72 similarly includes secondary swirler swirl vanes 102 that are circumferentially disposed in a row such that each of the secondary swirler swirl vanes 102 extends radially inward. The secondary swirler 72 is configured for swirling another corresponding portion of the pressurized air 82(*a*) from the pressure plenum 66 radially inward. The swirler assembly 51 further includes a flare cone 90 connected to the secondary swirler 72 downstream of the secondary swirler 72.

The fuel nozzle assembly 52 is seen to include the fuel nozzle 76 disposed within the swirler ferrule plate 74 of the swirler assembly 51. The fuel nozzle 76 injects a fuel 84 into the primary swirler venturi 88, where it is mixed with the air 82(*a*) from primary swirler 70. The fuel and air mixture in the primary swirler venturi 88 further mixes downstream in a conical opening 122 of the flare cone 90 with the air 82(*a*) from secondary swirler 72. The fuel and air mixture from the flare cone 90 is dispersed at a diverging angle from the flare cone 90 into the combustion chamber 62, where it is ignited and burned to generate the combustion product gases 86.

A deflector wall 92 extends radially outward from an annular axial wall outer surface 132 of the flare cone 90. The deflector wall is a generally annular wall that extends circumferentially about the mixer assembly centerline 69. The deflector wall 92 is also connected to support wall 94 of the dome assembly 54 at radially outward portions of the deflector wall 92 and the support wall 94. The support wall 94 is also seen to be connected to the annular axial wall outer surface 132 of the flare cone 90. A deflector wall cavity 96 is formed between the support wall 94, the deflector wall 92, and the annular axial wall outer surface 132 of the flare cone 90. The support wall 94 is seen to include a plurality of support wall cooling passages 108 therethrough, while deflector wall 92 is seen to include a plurality of deflector wall cooling passages 106 therethrough. A portion of the air 82(*a*) from the pressure plenum 66 flows through the support wall cooling passages 108 into the deflector wall cavity 96, and, then, through the deflector wall cooling passages 106 to provide film cooling of a deflector wall aft surface 138 of the deflector wall 92.

The flare cone 90 includes a flare cone cavity 104 formed therein. As will be described in more detail below with regard to FIG. 7, slotted cooling passages 154 may be included in the flare cone 90 to provide a flow of cooling air from the flare cone cavity 104 to an outlet at an annular step near an aft surface of the flare cone 90. Briefly, however, a portion of the air 82(*a*) from the deflector wall cavity 96 enters the flare cone cavity 104 via a plurality of flare cone cooling holes 152 (see FIG. 7) in the flare cone 90. The air 82(*a*) entering the flare cone cavity 104 then enters the slotted cooling passages 154 at an inlet 170 (see FIG. 7) and exits the slotted cooling passages 154 of the flare cone 90 at an outlet 172.

Figure 4:
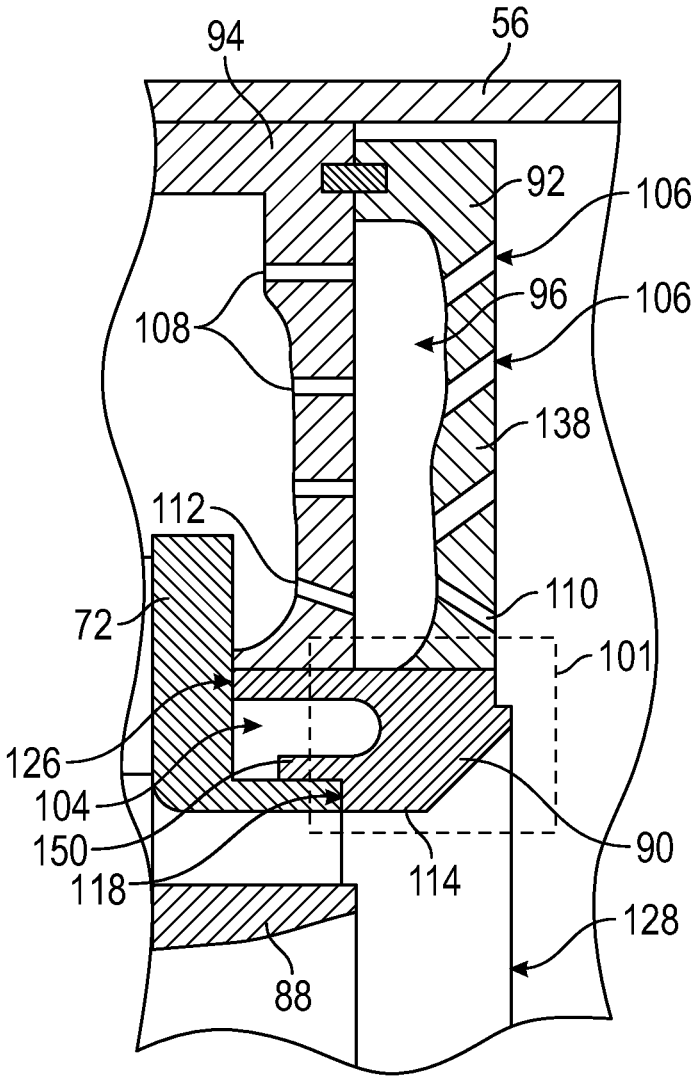
FIG. 4 is a partial cross-sectional side detail view of a portion of a flare cone, taken at detail 4-4 of FIG. 3, according to an aspect of the present disclosure.

FIG. 4 is an enlarged detail view taken at detail 4-4 shown in FIG. 3. FIG. 4 depicts a more detailed view of the flare cone 90, deflector wall 92 and support wall 94. In FIG. 4, flare cone 90 is seen to include an upstream end 126 and a downstream end 128. Support wall 94 includes the support wall cooling passages 108 that provide a flow of the air 82(*a*) from the pressure plenum 66 through the support wall 94 into the deflector wall cavity 96. The support wall cooling passages 108 may be aligned axially (i.e., parallel to mixer assembly centerline 69) or may be angled, such as a support wall cooling passage 112. The deflector wall 92 includes deflector wall cooling passages 106. As shown in FIG. 4, the deflector wall cooling passages 106 may be arranged radially outward such that the flow of air from the deflector wall cavity 96 is directed radially outward along the deflector wall aft surface 138 of the deflector wall 92. Of course, the deflector wall cooling passages 106 could also be arranged axially (i.e., parallel with the mixer assembly centerline 69) or with compound angles having radial, axial and tangential components. In addition, a deflector wall cooling passage 110 may be included to provide a flow of the air from the deflector wall cavity 96 radially inward along the deflector wall aft surface 138.

Figure 5:
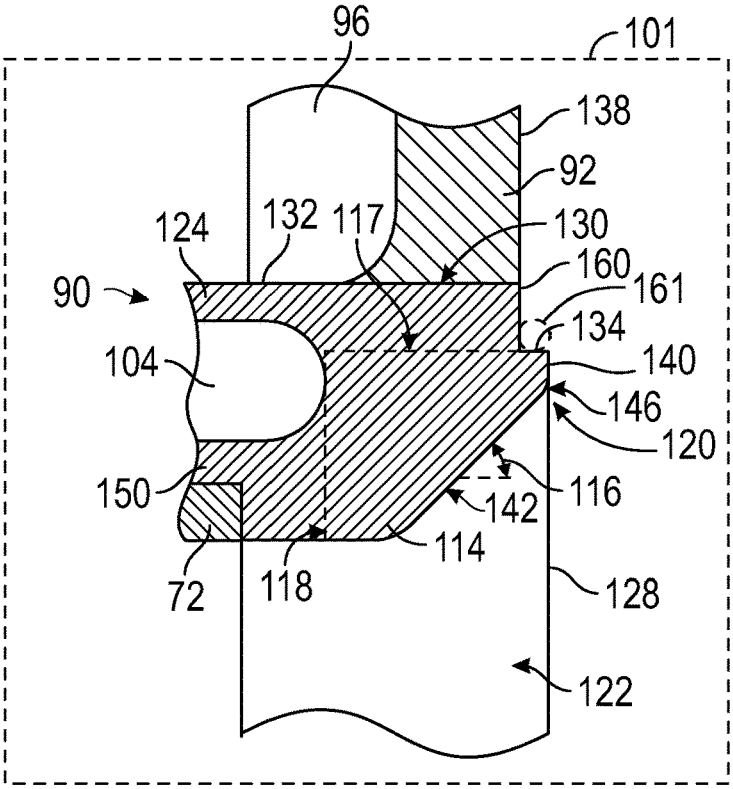
FIG. 5 is an enlarged detail view of one aspect of a flare cone, taken at detail 101 of FIG. 4, according to an aspect of the present disclosure.
Figure 6:
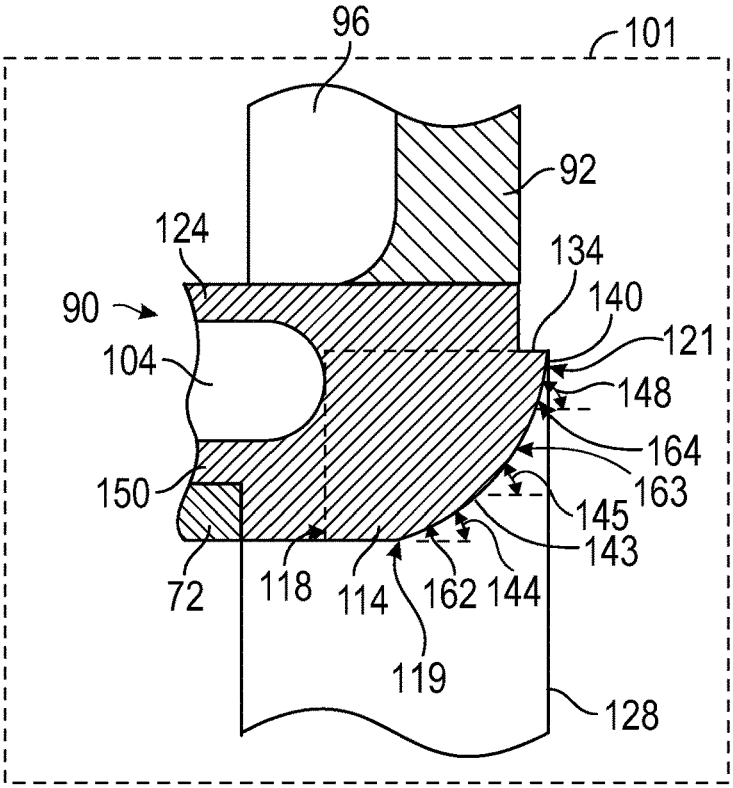
FIG. 6 is an enlarged detail view of another aspect of a flare cone, taken at detail 101 of FIG. 4, according to an aspect of the present disclosure.
Figure 7:
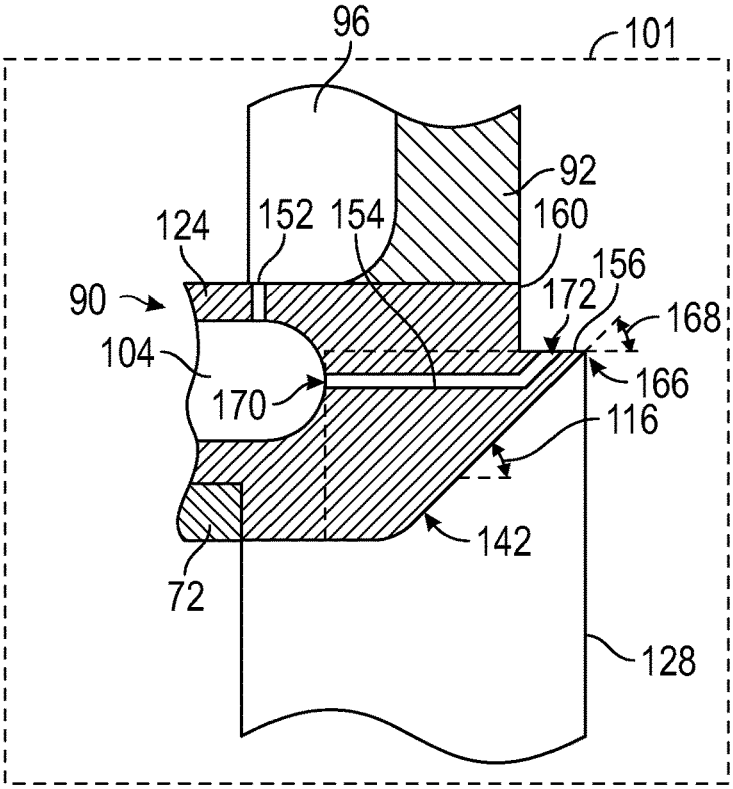
FIG. 7 is an enlarged detail view of yet another aspect of a flare cone, taken at detail 101 of FIG. 4, according to an aspect of the present disclosure.

FIGS. 5 to 7 are enlarged detail views taken at detail 101 of FIG. 4, and depict various different aspects of the flare cone 90. In FIG. 5, the flare cone 90 is seen to include an annular conical wall 114, an annular axial wall 124, and an annular inner axial wall 150. The annular conical wall 114, the annular axial wall 124, and the annular inner axial wall 150 each extend circumferentially about the mixer assembly centerline 69 (see FIG. 3). The mixer assembly centerline 69 may also be referred to as a flare cone centerline when referring to the flare cone itself, rather than the flare cone being part of the swirler assembly 51. The annular conical wall 114 includes an annular conical wall inner surface 142 arranged at a conical wall angle 116, and defines a conical opening 122 therethrough. The conical wall angle 116 may be, for example, forty-five degrees, or may be an angle in a range from thirty to sixty degrees. The annular axial wall 124 is disposed at a radially outer portion 117 of the annular conical wall 114 and is connected to the annular conical wall 114. The annular axial wall 124 extends in the longitudinal direction L (see FIG. 3) upstream from the annular conical wall 114 to the upstream end 126 (see FIG. 4) of the flare cone 90, where the annular axial wall 124 is connected with the secondary swirler 72 (see FIG. 4).

The annular inner axial wall 150 is connected to the annular conical wall 114 at an annular conical wall upstream end 118 of the annular conical wall 114, and extends in the longitudinal direction L upstream from the annular conical wall upstream end 118 of the annular conical wall 114. The annular inner axial wall 150 may extend to the upstream end 126 of the flare cone 90, or, as shown in FIG. 4, may extend partially between the annular conical wall upstream end 118 of the annular conical wall 114 and the upstream end 126 of the flare cone 90. The annular inner axial wall 150 is also connected to the secondary swirler 72. The annular inner axial wall 150 is radially spaced apart from the annular axial wall 124 so as to define the flare cone cavity 104 between the annular axial wall 124 and the annular inner axial wall 150. The flare cone cavity 104 may be an annular cavity that extends circumferentially about the mixer assembly centerline 69. The flare cone cooling holes 152 (see FIG. 7) are seen to be defined through the annular axial wall 124 and provide for a flow of the air 82(*a*) from the deflector wall cavity 96 to the flare cone cavity 104. The flow of air to the flare cone cavity 104 will be described in more detail below with regard to FIG. 7.

In the FIG. 5 aspect of the flare cone 90, the annular conical wall 114 includes an annular conical wall aft surface 140 that extends radially outward from an annular conical wall downstream end 120 of the annular conical wall inner surface 142. The annular conical wall aft surface 140 extends circumferentially about the mixer assembly centerline 69 and forms the downstream end 128 of the flare cone 90. A transition between the annular conical wall aft surface 140 and the annular conical wall inner surface 142 may include a round (or blend) 146, so as to provide a smoother transition of the flow exiting the flare cone. As seen in FIG. 5, an aft surface 160 of the annular axial wall 124 extends radially outward from the radially outer portion 117 of the annular conical wall 114. The aft surface 160 of the annular axial wall also extends circumferentially about the mixer assembly centerline 69. Thus, the annular conical wall aft surface 140 of the annular conical wall 114 and the aft surface 160 of the annular axial wall 124 may be generally parallel with one another in the radial direction R (see FIG. 3). The aft surface 160 of the annular axial wall 124, however, is longitudinally offset upstream of the annular conical wall aft surface 140 of the annular conical wall 114 so as to define an annular step 134 therebetween. The annular step 134, which is seen to be formed from a part of the annular conical wall 114, extends circumferentially about the mixer assembly centerline 69. A length of the annular step 134 in the longitudinal direction L may range from 0.03 inches to 0.08 inches (or about 0.76 mm to 2.0 mm). Of course, the length of the annular step 134 is not limited to the forgoing range and an annular step 134 that is longer or shorter in length than the foregoing range can be implemented instead. Thus, the annular step 134 provides for a smoother transitional flow of the fuel and air mixture exiting the flare cone into the combustion chamber at the downstream end of the flare cone so as to reduce the unsteady flame motion at the outlet end of the flare cone, thereby providing for better control of combustion instability. This is, at least in part, due to a recirculation bubble 161 that forms in the flow field at the annular step 134 during operation.

The deflector wall 92 is connected to the annular axial wall 124 at a downstream end 130 of the annular axial wall outer surface 132. The deflector wall aft surface 138 of the deflector wall 92 is seen to be radially aligned with the aft surface 160 of the annular axial wall 124. The deflector wall 92, while being shown as a separate element, may instead be formed integral with the flare cone 90.

FIG. 6 depicts another aspect of the flare cone 90 according to the present disclosure, taken again at detail 101 of FIG. 4. The flare cone aspect of FIG. 6 is somewhat similar to the flare cone aspect of FIG. 5, with one difference being that the annular conical wall inner surface 142 is a continuously curved (or contoured) conical inner surface instead. All other aspects of FIG. 6 are the same as those of FIG. 5 and a description thereof will not be repeated. In the FIG. 6 aspect of the flare cone 90, the annular conical wall inner surface 142 is a continuously curved conical inner surface 143. The continuously curved conical inner surface 143 starts at a first conical wall angle 144, and transitions from the first conical wall angle 144 to end at a second conical wall angle 148, forming a smooth curved surface in-between. A beginning portion 162 of the continuously curved conical inner surface 143, commencing at an upstream end 119 of the continuously curved conical inner surface 143, may be arranged at the first conical wall angle 144. The first conical wall angle 144 may be, for example, forty-five degrees with respect to the mixer assembly centerline 69, taken at a tangent along the continuously curved conical inner surface 143 at the beginning portion 162. The continuously curved conical inner surface 143 then angularly transitions to a steeper angle from the first conical wall angle 144 through a middle portion 163 along the length of the continuously curved conical inner surface 143. For example, the middle portion 163 may be arranged at a conical wall middle angle 145 of fifty-two or fifty-three degrees, taken at a tangent to the continuously curved inner surface 143 at the middle portion 163. The continuously curved conical inner surface 143 continues to angularly transition along its length to an even steeper angle at an ending portion 164 near a downstream end 121 of the continuously curved conical inner surface 143. The ending portion 164 may be arranged at the second conical wall angle 148, which may be, for example, sixty degrees with respect to the mixer assembly centerline 69, taken at a tangent along the continuously curved conical inner surface 143 at the ending portion 164. Thus, portions of the continuously curved conical inner surface 143 between the beginning portion 162 and the ending portion 164 transition from the forty-five degree first conical wall angle 144 to the sixty degree second conical wall angle 148. Alternatively, the first conical wall angle 144 may be thirty degrees, and the second conical wall angle 148 may be forty-five degrees. In yet still another aspect, the first conical wall angle 144 may be sixty degrees and the second conical wall angle 148 may be seventy-five degrees. Other angles besides the forgoing may be implemented instead, but as can be seen from the foregoing examples, the first conical wall angle 144 is less than the second conical wall angle 148 such that a steeper flow field is obtained as the surface transitions toward the outlet end of the flare cone. Thus, the arrangement of the flare cone in the FIG. 6 aspect can provide for a steeper transition of the flow along the surface of the annular conical wall of the flare cone exiting into the combustion chamber so as to provide for improved combustor dynamics.

FIG. 7 depicts yet another aspect of a flare cone 90 according to the present disclosure, also taken at detail 101 of FIG. 4. The flare cone of the aspect depicted in FIG. 7 is similar to that of the flare cone aspect depicted in FIG. 5, but with some differences being the inclusion of slotted cooling passages and a sharp edge 166 at the outlet end. In comparison, in the aspect of FIG. 5, the downstream end 128 of the flare cone 90 includes annular conical wall aft surface 140 that provides a smooth transition between the annular conical wall inner surface 142 and the annular step 134. In FIG. 7, however, the annular conical wall inner surface 142 and the annular step 156 form an acute angle 168 so as to define the sharp edge 166 of the flare cone 90. The acute angle 168 is generally the same as the conical wall angle 116, provided that the annular step 156 is close to parallel to the mixer assembly centerline 69. Thus, the annular step 156 may be longer in the longitudinal direction than the annular step 134 of FIG. 5. The longer length of the annular step 156 may also be utilized to allow for a slotted cooling passage outlet 172 to be provided through the surface of the annular step 156.

In this regard, the flare cone aspect of FIG. 7 includes a plurality of slotted cooling passages 154. The slotted cooling passages 154 include an inlet 170 at the flare cone cavity 104 and a slotted cooling passage outlet 172 at the annular step 156. A portion of the air 82(*a*) from the pressure plenum 66 flows through the cooling passages (108/112) of the support wall 94 (see FIG. 4) into the deflector wall cavity 96, and then through the flare cone cooling holes 152 into the flare cone cavity 104, and then, through the slotted cooling passages 154 to provide film cooling at the annular step 156. A plurality of the slotted cooling passages 154 may be provided circumferentially about the mixer assembly centerline 69, and they may be spaced apart in a circumferential direction from one another. Thus, while the flare cone cavity 104 may be an annular cavity, the plurality of slotted cooling passages 154 may be included to provide fluid communication between and flare cone cavity 104 and various portions of the annular step 156 where the outlets 172 are arranged through the surface of the annular step 156. The number of slotted cooling passages 154 and the circumferential spacing, as well as the actual size (e.g., height, width) of the slotted cooling passages may be varied to provide a desired amount of cooling to the annular step 156.

Figure 8:
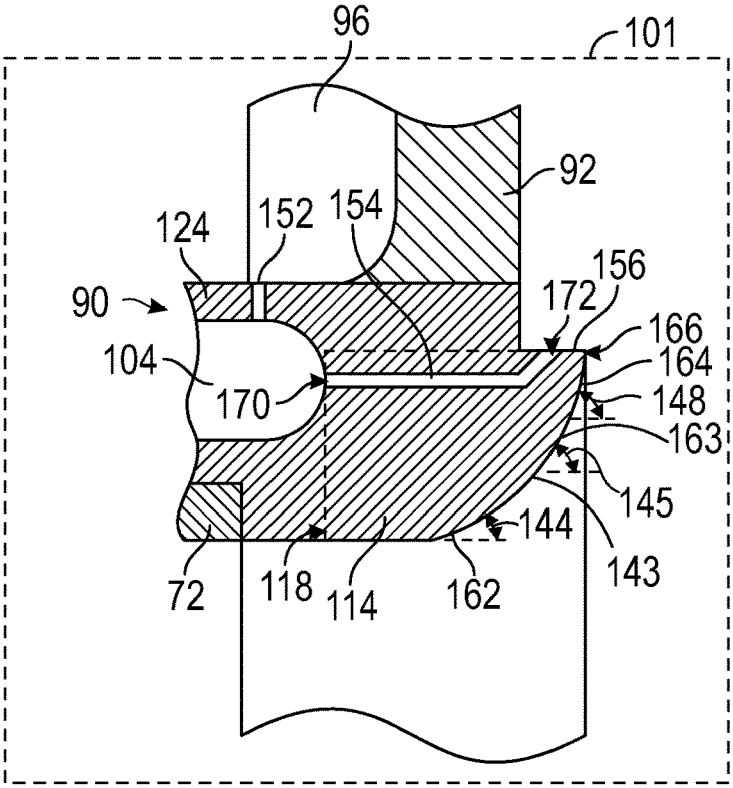
FIG. 8 is an enlarged detail view of still another aspect of a flare cone, taken at detail 101 of FIG. 4, according to an aspect of the present disclosure.

FIG. 8 depicts still another aspect of the flare cone according to the present disclosure, taken at detail 101 of FIG. 4. The FIG. 8 aspect of the flare cone 90 is similar to the FIG. 7 aspect. One difference between the FIG. 8 aspect and the FIG. 7 aspect is that, the FIG. 8 aspect includes the continuously curved conical inner surface 143, similar to that shown and described with regard to FIG. 6. Thus, the elements of the continuously curved conical inner surface 143 described above for FIG. 6 are applicable to the FIG. 8 aspect and will not be described again herein. All other aspects of FIG. 8 are the same as those of FIG. 7 and a description thereof will not be repeated.

Figure 9:
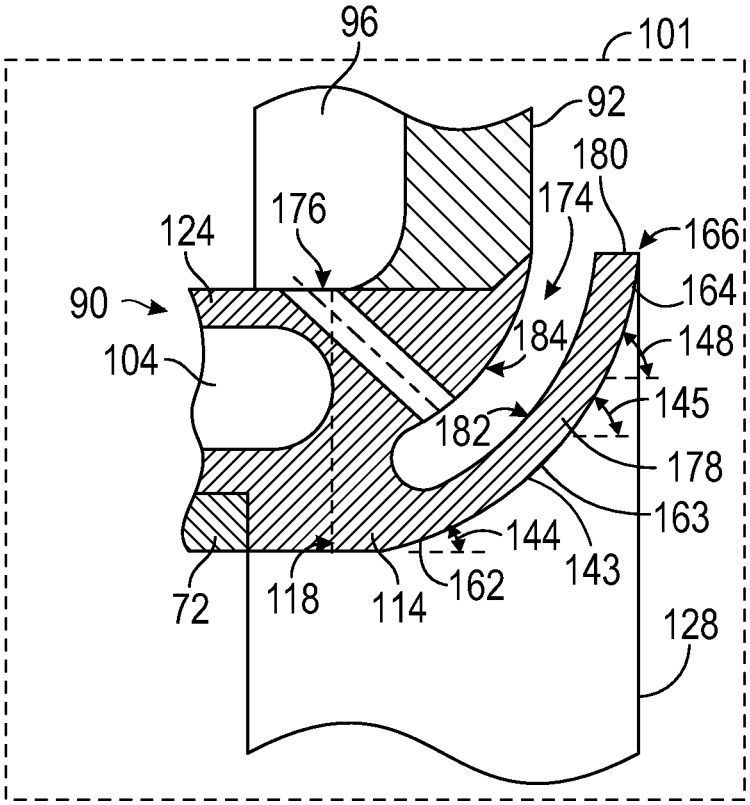
FIG. 9 is an enlarged detail view of still yet another aspect of a flare cone, taken at detail 101 of FIG. 4, according to an aspect of the present disclosure.

FIG. 9 depicts yet still another aspect of a flare cone according to the present disclosure, taken at detail 101 of FIG. 4. In the FIG. 9 aspect, the annular conical wall 114 includes the continuously curved conical inner surface 143. The continuously curved conical inner surface 143 of FIG. 9 may be similar to, and include the same elements as those depicted in FIG. 6 as described above. Therefore, they will not be described again. The annular conical wall 114 of FIG. 9, however, includes a backside cooling passage 174. The backside cooling passage 174 may generally begin near the annular conical wall upstream end 118 of the annular conical wall 114 and extend radially outward and downstream therefrom through the annular step 180. The backside cooling passage 174 may also include a continuously curved profile similar to the continuously curved conical inner surface 143. Thus, a backside cooling passage aft surface 182 of the backside cooling passage 174 may have a continuously curved profile that is congruent to the continuously curved conical inner surface 143. A backside cooling passage forward surface 184 of the backside cooling passage 174 may also have a continuously curved profile that is generally congruent to the aft surface 182 of the backside cooling passage 174. The backside cooling passage 174 may also extend circumferentially about the mixer assembly centerline 69.

With the implementation of the backside cooling passage 174, a flare cone flange 178 is defined. The flare cone flange 178 is defined between the continuously curved conical inner surface 143 and the aft surface 182 of the backside cooling passage 174. The flare cone flange 178 includes the sharp edge 166. The flare cone flange 178 also includes an annular step 180 that generally extends in the longitudinal direction and generally corresponds to the annular step 134 (see FIGS. 5 and 6).

The annular conical wall 114 of FIG. 9 further includes a plurality of impingement cooling holes 176. The impingement cooling holes 176 extend through the annular conical wall 114 from the deflector wall cavity 96 to the backside cooling passage 174. In FIG. 9, the impingement cooling holes 176 are shown as being angled, but they may be arranged perpendicular to the mixer assembly centerline 69 (see FIG. 3) instead. A plurality of the impingement cooling holes 176 may be arranged about the circumference of the annular conical wall 114 and may be circumferentially spaced apart from one another. The number of impingement cooling holes 176, as well as the size, shape, and spacing, may be based on a particular amount of impingement cooling to be provided to the flare cone flange 178. In operation, cooling air from the deflector wall cavity 96 flows through the plurality of impingement cooling holes 176 into the backside cooling passage 174, and, then, exits the backside cooling passage 174 at the annular step 180. Thus, impingement cooling can be provided to the flare cone flange 178. Additionally, the continuously curved conical inner surface 143, and, in particular, the steeper angled ending portion 164, provides for a better transitional flow of the fuel and air mixture out of the flare cone into the combustor, thereby improving the stability of flame as well as durability of the flare cone. The continuously curved backside cooling passage 174 also provides the flow of cooling air directed in the same general angular direction as the fuel-air mixture so as to improve the combustion dynamics.

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A mixer assembly of a combustor, the mixer assembly defining a mixer assembly centerline therethrough, the mixer assembly including a swirler assembly including a primary swirler and a secondary swirler disposed downstream of the primary swirler; and a flare cone disposed at a downstream end of the secondary swirler, the flare cone comprising: (a) an annular conical wall extending circumferentially about the mixer assembly centerline, the annular conical wall including a conical inner surface defining a conical opening of the annular conical wall, and (b) an annular axial wall extending in a longitudinal direction with respect to the mixer assembly centerline, the annular axial wall disposed at a radially outward portion of the annular conical wall and connected to the annular conical wall, wherein the annular conical wall and the annular axial wall define an annular step circumferentially about the mixer assembly centerline and extending upstream in the longitudinal direction between an aft end of the annular conical wall and an aft surface of the annular axial wall.

The mixer assembly according to any preceding clause, wherein the downstream end of the annular conical wall comprises an annular conical wall aft surface extending radially outward from a downstream end of the conical inner surface of the annular conical wall to the annular step.

The mixer assembly according to any preceding clause, wherein the conical inner surface of the annular conical wall comprises a continuously curved conical inner surface extending from an upstream end of the continuously curved conical inner surface to a downstream end of the continuously curved conical inner surface.

The mixer assembly according to according to any preceding clause, wherein (a) a beginning portion of the continuously curved conical inner surface at the upstream end of the continuously curved conical inner surface is arranged at a first conical wall angle with respect to the mixer assembly centerline, (b) an ending portion of the continuously curved conical inner surface at the downstream end of the continuously curved conical inner surface is arranged at a second conical wall angle with respect to the mixer assembly centerline, and (c) a middle portion of the continuously curved conical inner surface between the beginning portion and the ending portion transitions from the first conical wall angle to the second conical wall angle.

The mixer assembly according to any preceding clause, wherein the first conical wall angle is forty-five degrees and the second conical wall angle is sixty degrees.

The mixer assembly according to any preceding clause, wherein the flare cone further comprises an annular inner axial wall extending upstream in the longitudinal direction from an upstream end of the annular conical wall, wherein an annular cavity is defined between the annular axial wall and the annular inner axial wall.

The mixer assembly according to any preceding clause, wherein the flare cone includes a plurality of slotted cooling passages each having an inlet at the annular cavity and an outlet at a surface of the annular step.

The mixer assembly according to according to any preceding clause, wherein the surface of the annular step and the conical inner surface of the annular conical wall intersect at the downstream end of the annular conical wall and form an acute angle therebetween.

The mixer assembly according to any preceding clause, wherein the conical inner surface of the annular conical wall comprises a continuously curved conical inner surface extending from an upstream end of the continuously curved conical inner surface to a downstream end of the continuously curved conical inner surface.

The mixer assembly according to any preceding clause, wherein (a) a beginning portion of the continuously curved conical inner surface at the upstream end of the continuously curved conical inner surface is arranged at a first conical wall angle with respect to the mixer assembly centerline, (b) an ending portion of the continuously curved conical inner surface at the downstream end of the continuously curved conical inner surface is arranged at a second conical wall angle with respect to the mixer assembly centerline, and (c) a middle portion of the continuously curved conical inner surface between the beginning portion and the ending portion transitions from the first conical wall angle to the second conical wall angle.

The mixer assembly according to any preceding clause, wherein the first conical wall angle is forty-five degrees and the second conical wall angle is sixty degrees.

The mixer assembly according to any preceding clause, further comprising a deflector wall connected to the annular axial wall at a downstream end of the annular axial wall, and extending radially outward from an outer surface of the annular axial wall, wherein the deflector wall is formed integral with the flare cone.

The mixer assembly according to any preceding clause, wherein the deflector wall includes a plurality of cooling passages therethrough.

The mixer assembly according to any preceding clause, wherein the annular conical wall further comprises a backside cooling passage, wherein a flare cone flange is defined between the backside cooling passage and the conical inner surface of the annular conical wall, wherein the conical inner surface of the annular conical wall comprises a continuously curved conical inner surface extending from an upstream end of the continuously curved conical inner surface to a downstream end of the continuously curved conical inner surface, and wherein (a) a beginning portion of the continuously curved conical inner surface at the upstream end of the continuously curved conical inner surface is arranged at a first conical wall angle with respect to the mixer assembly centerline, (b) an ending portion of the continuously curved conical inner surface at the downstream end of the continuously curved conical inner surface is arranged at a second conical wall angle with respect to the mixer assembly centerline, and (c) a middle portion of the continuously curved conical inner surface between the beginning portion and the ending portion transitions from the first conical wall angle to the second conical wall angle.

The mixer assembly according to any preceding clause, wherein the first conical wall angle is forty-five degrees and the second conical wall angle is sixty degrees.

The mixer assembly according to any preceding clause, wherein the backside cooling passage includes a backside cooling passage aft surface that is a continuously curved surface that is congruent with the continuously curved conical inner surface.

A flare cone for a mixer assembly, the flare cone defining a flare cone centerline therethrough, the flare cone comprising: an annular conical wall extending circumferentially about the flare cone centerline, the annular conical wall including a conical inner surface defining a conical opening of the annular conical wall; and an annular axial wall extending in a longitudinal direction with respect to the flare cone centerline, the annular axial wall disposed at a radially outward portion of the annular conical wall and connected to the annular conical wall, wherein the annular conical wall and the annular axial wall define an annular step circumferentially about the flare cone centerline and extending upstream in the longitudinal direction between a downstream end of the annular conical wall and an aft surface of the annular axial wall.

The flare cone according to any preceding clause, wherein the downstream end of the annular conical wall comprises an annular conical wall aft surface extending radially outward from a downstream end of the conical inner surface of the annular conical wall to the annular step.

The flare cone according to any preceding clause, wherein the conical inner surface of the annular conical wall comprises a continuously curved conical inner surface extending from an upstream end of the continuously curved conical inner surface to a downstream end of the continuously curved conical inner surface.

The flare cone according to any preceding clause, wherein (a) a beginning portion of the continuously curved conical inner surface at the upstream end of the continuously curved conical inner surface is arranged at a first conical wall angle with respect to the flare cone centerline, (b) an ending portion of the continuously curved conical inner surface at the downstream end of the continuously curved conical inner surface is arranged at a second conical wall angle with respect to the flare cone centerline, and (c) a middle portion of the continuously curved conical inner surface between the beginning portion and the ending portion transitions from the first conical wall angle to the second conical wall angle.

The flare cone according to any preceding clause, wherein the first conical wall angle is forty-five degrees and the second conical wall angle is sixty degrees.

The flare cone according to any preceding clause, wherein the flare cone further comprises an annular inner axial wall extending in the longitudinal direction upstream from an upstream end of the annular conical wall, wherein an annular cavity is defined between the annular axial wall and the annular inner axial wall.

The flare cone according to any preceding clause, wherein the flare cone includes a plurality of slotted cooling passages each having an inlet at the annular cavity and an outlet at a surface of the annular step.

The flare cone according to any preceding clause, wherein the surface of the annular step and the conical inner surface of the annular conical wall intersect at the downstream end of the annular conical wall and form an acute angle therebetween.

The flare cone according to any preceding clause, wherein the conical inner surface of the annular conical wall comprises a continuously curved conical inner surface extending from an upstream end of the conical inner surface to a downstream end of the conical inner surface.

The flare cone according to any preceding clause, wherein (a) a beginning portion of the continuously curved conical inner surface at the upstream end of the continuously curved conical inner surface is arranged at a first conical wall angle with respect to the flare cone centerline, (b) an ending portion of the continuously curved conical inner surface at the downstream end of the continuously curved conical inner surface is arranged at a second conical wall angle with respect to the flare cone centerline, and (c) a middle portion of the continuously curved conical inner surface between the beginning portion and the ending portion transitions from the first conical wall angle to the second conical wall angle.

The flare cone according to any preceding clause, wherein the first conical wall angle is forty-five degrees and the second conical wall angle is sixty degrees.

The flare cone according to any preceding clause, further comprising a deflector wall connected to the annular axial wall at a downstream end of the annular axial wall, and extending radially outward from an outer surface of the annular axial wall, wherein the deflector wall is formed integral with the flare cone.

The flare cone according to any preceding clause, wherein the deflector wall includes a plurality of cooling passages therethrough.

The flare cone according to any preceding clause, wherein the annular conical wall further comprises a backside cooling passage, wherein a flare cone flange is defined between the backside cooling passage and the conical inner surface of the annular conical wall, wherein the conical inner surface of the annular conical wall comprises a continuously curved conical inner surface extending from an upstream end of the continuously curved conical inner surface to a downstream end of the continuously curved conical inner surface, and wherein (a) a beginning portion of the continuously curved conical inner surface at the upstream end of the continuously curved conical inner surface is arranged at a first conical wall angle with respect to the flare cone centerline, (b) an ending portion of the continuously curved conical inner surface at the downstream end of the continuously curved conical inner surface is arranged at a second conical wall angle with respect to the flare cone centerline, and (c) a middle portion of the continuously curved conical inner surface between the beginning portion and the ending portion transitions from the first conical wall angle to the second conical wall angle.

The flare cone according to any preceding clause, wherein the first conical wall angle is forty-five degrees and the second conical wall angle is sixty degrees.

The flare cone according to any preceding clause, wherein the backside cooling passage includes a backside cooling passage aft surface that is a continuously curved surface that is congruent with the continuously curved conical inner surface.

Although the foregoing description is directed to some exemplary embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A mixer assembly of a combustor, the mixer assembly defining a centerline axis therethrough, the mixer assembly comprising:

a swirler assembly including a primary swirler and a secondary swirler disposed downstream of the primary swirler; and a flare cone disposed at a downstream end of the secondary swirler, the flare cone comprising: (a) an annular conical wall extending circumferentially about the centerline axis, the annular conical wall including a conical inner surface defining a conical opening of the annular conical wall, and (b) an annular axial wall extending in a longitudinal direction with respect to the centerline axis, the annular axial wall disposed at a radially outward portion of the annular conical wall and connected to the annular conical wall, wherein the annular conical wall and the annular axial wall define an annular step circumferentially about the centerline axis and extending upstream in the longitudinal direction between a downstream end of the annular conical wall and an aft surface of the annular axial wall, wherein the flare cone further comprises an annular inner axial wall extending upstream in the longitudinal direction from an upstream end of the annular conical wall, wherein an annular cavity is defined between the annular axial wall and the annular inner axial wall, and wherein the flare cone includes a plurality of slotted cooling passages each having an inlet at the annular cavity and an outlet at a surface of the annular step.

2. The mixer assembly according to claim 1, wherein the downstream end of the annular conical wall comprises an annular conical wall aft surface extending radially outward from a downstream end of the conical inner surface of the annular conical wall to the annular step.

3. The mixer assembly according to claim 1, wherein the conical inner surface of the annular conical wall comprises a continuously curved conical inner surface extending from an upstream end of the continuously curved conical inner surface to a downstream end of the continuously curved conical inner surface.

4. The mixer assembly according to claim 3, wherein (a) a beginning portion of the continuously curved conical inner surface at the upstream end of the continuously curved conical inner surface is arranged at a first conical wall angle with respect to the centerline axis, (b) an ending portion of the continuously curved conical inner surface at the downstream end of the continuously curved conical inner surface is arranged at a second conical wall angle with respect to the centerline axis, and (c) a middle portion of the continuously curved conical inner surface between the beginning portion and the ending portion transitions from the first conical wall angle to the second conical wall angle.

5. The mixer assembly according to claim 4, wherein the first conical wall angle is forty-five degrees and the second conical wall angle is sixty degrees.

6. The mixer assembly according to claim 1, wherein the surface of the annular step and the conical inner surface of the annular conical wall intersect at the downstream end of the annular conical wall and form an acute angle therebetween.

7. The mixer assembly according to claim 6, wherein the conical inner surface of the annular conical wall comprises a continuously curved conical inner surface extending from an upstream end of the continuously curved conical inner surface to a downstream end of the continuously curved conical inner surface.

8. The mixer assembly according to claim 7, wherein (a) a beginning portion of the continuously curved conical inner surface at the upstream end of the continuously curved conical inner surface is arranged at a first conical wall angle with respect to the centerline axis, (b) an ending portion of the continuously curved conical inner surface at the downstream end of the continuously curved conical inner surface is arranged at a second conical wall angle with respect to the centerline axis, and (c) a middle portion of the continuously curved conical inner surface between the beginning portion and the ending portion transitions from the first conical wall angle to the second conical wall angle.

9. The mixer assembly according to claim 8, wherein the first conical wall angle is forty-five degrees and the second conical wall angle is sixty degrees.

10. The mixer assembly according to claim 1, further comprising a deflector wall connected to the annular axial wall at a downstream end of the annular axial wall, and extending radially outward from an outer surface of the annular axial wall, wherein the deflector wall is formed integral with the flare cone.

11. The mixer assembly according to claim 10, wherein the deflector wall includes a plurality of cooling passages therethrough.

12. A mixer assembly of a combustor, the mixer assembly defining a centerline axis therethrough, the mixer assembly comprising:

a swirler assembly including a primary swirler and a secondary swirler disposed downstream of the primary swirler; and a flare cone disposed at a downstream end of the secondary swirler, the flare cone comprising: (a) an annular conical wall extending circumferentially about the centerline axis, the annular conical wall including a conical inner surface defining a conical opening of the annular conical wall, and (b) an annular axial wall extending in a longitudinal direction with respect to the centerline axis, the annular axial wall disposed at a radially outward portion of the annular conical wall and connected to the annular conical wall, wherein the annular conical wall and the annular axial wall define an annular step circumferentially about the centerline axis and extending upstream in the longitudinal direction between a downstream end of the annular conical wall and an aft surface of the annular axial wall, wherein the annular conical wall further comprises a backside cooling passage, wherein a flare cone flange is defined between the backside cooling passage and the conical inner surface of the annular conical wall, wherein the conical inner surface of the annular conical wall comprises a continuously curved conical inner surface extending from an upstream end of the continuously curved conical inner surface to a downstream end of the continuously curved conical inner surface, and wherein (a) a beginning portion of the continuously curved conical inner surface at the upstream end of the continuously curved conical inner surface is arranged at a first conical wall angle with respect to the centerline axis, (b) an ending portion of the continuously curved conical inner surface at the downstream end of the continuously curved conical inner surface is arranged at a second conical wall angle with respect to the centerline axis, and (c) a middle portion of the continuously curved conical inner surface between the beginning portion and the ending portion transitions from the first conical wall angle to the second conical wall angle.

13. The mixer assembly according to claim 12, wherein the first conical wall angle is forty-five degrees and the second conical wall angle is sixty degrees.

14. The mixer assembly according to claim 12, wherein the backside cooling passage includes a backside cooling passage aft surface that is a continuously curved surface that is congruent with the continuously curved conical inner surface.

15. A flare cone for a mixer assembly, the flare cone defining a centerline axis therethrough, the flare cone comprising:

an annular conical wall extending circumferentially about the centerline axis, the annular conical wall including a conical inner surface defining a conical opening of the annular conical wall; and an annular axial wall extending in a longitudinal direction with respect to the centerline axis, the annular axial wall disposed at a radially outward portion of the annular conical wall and connected to the annular conical wall, wherein the annular conical wall and the annular axial wall define an annular step circumferentially about the centerline axis and extending upstream in the longitudinal direction between a downstream end of the annular conical wall and an aft surface of the annular axial wall, wherein the flare cone further comprises an annular inner axial wall extending upstream in the longitudinal direction from an upstream end of the annular conical wall, wherein an annular cavity is defined between the annular axial wall and the annular inner axial wall, and wherein the flare cone includes a plurality of slotted cooling passages each having an inlet at the annular cavity and an outlet at a surface of the annular step.

16. The flare cone according to claim 15, wherein the downstream end of the annular conical wall comprises an annular conical wall aft surface extending radially outward from an aft end of the conical inner surface of the annular conical wall to the annular step.

17. The flare cone according to claim 15, wherein the conical inner surface of the annular conical wall comprises a continuously curved conical inner surface extending from an upstream end of the continuously curved conical inner surface to a downstream end of the continuously curved conical inner surface.

18. The flare cone according to claim 17, wherein (a) a beginning portion of the continuously curved conical inner surface at the upstream end of the continuously curved conical inner surface is arranged at a first conical wall angle with respect to the centerline axis, (b) an ending portion of the continuously curved conical inner surface at the downstream end of the continuously curved conical inner surface is arranged at a second conical wall angle with respect to the centerline axis, and (c) a middle portion of the continuously curved conical inner surface between the beginning portion and the ending portion transitions from the first conical wall angle to the second conical wall angle.

19. A flare cone for a mixer assembly, the flare cone defining a centerline axis therethrough, the flare cone comprising:

an annular conical wall extending circumferentially about the centerline axis, the annular conical wall including a conical inner surface defining a conical opening of the annular conical wall; and an annular axial wall extending in a longitudinal direction with respect to the centerline axis, the annular axial wall disposed at a radially outward portion of the annular conical wall and connected to the annular conical wall, wherein the annular conical wall and the annular axial wall define an annular step circumferentially about the centerline axis and extending upstream in the longitudinal direction between a downstream end of the annular conical wall and an aft surface of the annular axial wall, wherein the annular conical wall further comprises a backside cooling passage, wherein a flare cone flange is defined between the backside cooling passage and the conical inner surface of the annular conical wall, wherein the conical inner surface of the annular conical wall comprises a continuously curved conical inner surface extending from an upstream end of the continuously curved conical inner surface to a downstream end of the continuously curved conical inner surface, and wherein (a) a beginning portion of the continuously curved conical inner surface at the upstream end of the continuously curved conical inner surface is arranged at a first conical wall angle with respect to the centerline axis, (b) an ending portion of the continuously curved conical inner surface at the downstream end of the continuously curved conical inner surface is arranged at a second conical wall angle with respect to the centerline axis, and (c) a middle portion of the continuously curved conical inner surface between the beginning portion and the ending portion transitions from the first conical wall angle to the second conical wall angle.

* * * * *